US007191921B2

(12) United States Patent
Redlin

(10) Patent No.: US 7,191,921 B2
(45) Date of Patent: Mar. 20, 2007

(54) APPARATUS FOR PRESSING SHIRT-LIKE ITEMS OF CLOTHING

(75) Inventor: Kathrin Redlin, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/849,677

(22) Filed: May 20, 2004

(65) Prior Publication Data

US 2005/0067442 A1 Mar. 31, 2005

Related U.S. Application Data

(63) Continuation of application No. PCT/EP02/12338, filed on Nov. 5, 2002.

(30) Foreign Application Priority Data

Nov. 20, 2001 (DE) ..... 101 56 859

(51) Int. Cl.
*D06F 71/40* (2006.01)
*D06F 71/20* (2006.01)

(52) U.S. Cl. ..... 223/70

(58) Field of Classification Search ..... 223/52.5, 223/67, 68, 70, 71, 57, 52.1, 72, 73, 74; 38/12, 38/14, 16, 64
See application file for complete search history.

(56) References Cited

U.S. PATENT DOCUMENTS 2,361,045 A * 10/1944 Miller ..... 223/68
2,412,172 A * 12/1946 Pettit ..... 223/67
2,417,838 A * 3/1947 Paris ..... 223/67
2,513,427 A * 7/1950 Richa et al. ..... 223/67
2,689,996 A * 9/1954 Glattes ..... 24/508
3,165,244 A 1/1965 Dosal
3,490,660 A * 1/1970 Sherbondy ..... 223/71
3,583,610 A * 6/1971 Forse ..... 223/57
4,303,183 A * 12/1981 Schlemon ..... 223/67
6,443,067 B2 * 9/2002 Kimura ..... 101/415.1
6,957,754 B2 * 10/2005 Bolan et al. ..... 223/73

FOREIGN PATENT DOCUMENTS

| | | |
|---|---|---|
| DE | 1 966 153 | 11/1971 |
| DE | 24 62 658 B1 | 10/1979 |
| EP | 1 069 229 A1 | 1/2001 |
| GB | 553656 | 5/1943 |
| GB | 564369 | 9/1944 |

* cited by examiner

*Primary Examiner*—Ismael Izaguirre
(74) *Attorney, Agent, or Firm*—Russell W. Warnock; Craig J. Loest

(57) ABSTRACT

Garments can be pressed with a shirt-like inflatable body that is stretched from the inside. The device has a bottom part with a blower for inflating the inflatable body. The bottom part also has a button-strip clamp for fixing the edges of the garments. In order to be able to also press shirt-like garments that cannot be opened, such as sweaters and the like, using said device, the novel apparatus has a locking device by way of which the button-strip clamp can be released from the working position near the inflatable body. Upon release, the button-strip clamp can be placed at a distance from the inflatable body or totally removed from the device in order to stretch and press closed garments on the inflatable body.

15 Claims, 1 Drawing Sheet

APPARATUS FOR PRESSING SHIRT-LIKE ITEMS OF CLOTHING

CROSS-REFERENCE TO RELATED APPLICATION

This application is a continuation, under 35 U.S.C. § 120, of copending International Application No. PCT/EP02/12338, filed Nov. 5, 2002, which designated the United States; the application further claims the priority, under 35 U.S.C. § 119 of German patent application 101 56 859.2, filed Nov. 20, 2001; the two prior applications are herewith incorporated by reference in their entirety.

BACKGROUND OF THE INVENTION

FIELD OF THE INVENTION

The invention relates to an apparatus for pressing items of clothing, with a shirt-like inflatable body and a button-strip clamp. The button-strip clamp is used for fixing the edges of an article of clothing that can be opened.

In the case of such apparatus, the woven fabric of the items of clothing is tensioned in order to be pressed. For this purpose, it may be advantageous, depending on the shape of the item of clothing which is to be pressed, for the item of clothing to be fixed at various locations for tensioning purposes. For example, it is recommendable with dress shirts, rather than them being pressed in the buttoned-up state, for the button strip or buttonhole strip to be fixed by a button-strip clamp. The shirt can thus be removed more quickly from the inflatable body following the pressing operation since releasing the fixing means usually takes up less time than unbuttoning the shirt. The same applies to other front-opening items of clothing such as, for example, jackets.

U.S. Pat. No. 3,165,244 discloses an apparatus which is provided for pressing shirts and in the case of which the button strip and the buttonhole strip are retained parallel one beside the other in each case by a plurality of clamping jaws. The clamping jaws for the button strip or the buttonhole strip are prestressed in each case by a spring and connected to one another by a strip, with the result that a user can open and close them together. The clamping arrangement is fixed to the shirt-pressing apparatus and has the disadvantage that shirt-like items of clothing which do not open at the front cannot be pressed by the shirt-pressing apparatus since the clamping jaws prevent these from being pulled on.

SUMMARY OF THE INVENTION

It is accordingly an object of the invention to provide a apparatus for pressing shirt-like articles of clothing which overcomes the above-mentioned disadvantages of the heretofore-known devices and methods of this general type and which renders it possible to press both closed and openable shirt-like items of clothing.

With the foregoing and other objects in view there is provided, in accordance with the invention, an apparatus for pressing items of clothing, comprising:

an inflatable body having a shirt-like form;

a button-strip clamp for fixing free edges of an openable item of clothing disposed in a vicinity of said inflatable body and movable into an operating position in close vicinity in front of said inflatable body; and a locking device for releasably fastening said button-strip clamp in the operating position thereof.

In other words, the novel pressing apparatus has a locking device with which the button-strip clamp can be connected to the pressing apparatus such that the button-strip clamp, in an operating position thereof, can be arranged in the vicinity of the inflatable body and can also be spaced apart from the inflatable body. In the operating position, the button-strip clamp is located closely enough to the inflatable body for it to be able to perform its function and to fix the edges of front-opening items of clothing. In its position in which it is spaced apart from the inflatable body, in contrast, it is possible, using the apparatus according to the invention, for closed items of clothing to be pulled over the inflatable body and pressed.

In a preferred embodiment of the invention, the locking device has a pivot hinge by which the button-strip clamp is articulated on the pressing apparatus. It is thus possible, with particularly low outlay, to provide a connection which allows the button-strip clamp to be arranged both in its operating position and at a distance apart from the inflatable body. The articulated connection ensures that the button-strip clamp is accommodated even when it is not located in its operating position. In the case of an articulated connection, furthermore, it may be provided that the button-strip clamp can be locked in its position in which it is spaced apart from the inflatable body, in order to prevent unintended deflection in the direction of its operating position. In this case, the button-strip clamp can be locked in its operating position by the rotary movement in the articulation being arrested. It is thus possible for the components which are necessary both for articulation and for locking purposes to be accommodated in a confined amount of space in the articulation.

However, the button-strip clamp is advantageously connected in an articulated manner to the pressing apparatus at one end and, at its opposite end, has connecting means for releasable connection to the pressing apparatus. This can give rise to more favorable loading of the connecting locations since the button-strip clamp is connected to the pressing apparatus at both ends and none of the connecting locations has to transmit any moments. The connecting means at the connecting locations need only transmit tensile forces. In order to provide for the top connecting location, the pressing apparatus may have a framework which extends at least as far as the top connecting location. The framework may also advantageously be arranged partially within the inflatable body, with the result that it is at least partially concealed and does not form an obstruction when items of clothing are pulled on.

It is possible here for the articulation to be provided at the bottom end of the button-strip clamp. Since the button-strip clamp is usually arranged vertically in its operating position, this can achieve the situation where the button-strip clamp, following unlocking of the fastening and tilting by way of gravitational force, is retained in a position in which it is spaced apart from the inflatable body.

Furthermore, the button-strip clamp may be connected to the pressing apparatus in a fully releasable manner. For this purpose, it is possible for the button-strip clamp advantageously to be connected to the pressing apparatus by means of two connecting means, the connecting means advantageously acting on the button-strip clamp at a large distance from one another, in order to achieve favorable loading of the connecting means. The button-strip clamp can thus be completely removed, with the result that it does not form an obstruction when closed items of clothing are pulled onto the inflatable body.

In its operating position, the button-strip clamp is arranged such that it can fix the edges of openable items of clothing in the vicinity of the surface of the inflatable body. The aim here is for the items of clothing to be fixed such that they do not develop any creases during the tensioning operation. The edges are advantageously fixed in the plane in which they would be located if the relevant item of clothing were pulled onto the inflatable body in the closed state. For this purpose, the button-strip clamp can fix the edges of the item of clothing in the plane in which the regions of the inflatable body on both sides of the button-strip clamp are also located.

Since the button-strip clamp necessarily has a certain extent perpendicular to the surface of the inflatable body, this may give rise to the situation where the button-strip clamp has to press some way into the inflatable body by way of its rear side in order to be able to fix the edges of the item of clothing in an optimum position. This may result in the inflatable body being subjected to a pressure which possibly deflects the inflatable body. In order to avoid this, the pressing apparatus may have devices for supporting the inflatable body. These supporting devices are advantageously set up such that they only perform their supporting action when the button-strip clamp is in its operating position.

These supporting devices may be, for example, inflatable cushions which are inflated at a higher pressure than the inflatable body and are supported against a framework in the interior of the inflatable body. It is possible here for the framework or part of the framework to be operatively connected to the button-strip clamp such that it increases the pressure of the inflatable cushion or cushions when the button-strip clamp is in its operating position, in order, in this state, for the supporting action of the inflatable cushion or cushions to be increased.

Other features which are considered as characteristic for the invention are set forth in the appended claims.

Although the invention is illustrated and described herein as embodied in an apparatus for pressing shirt-like items of clothing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Figure 1:
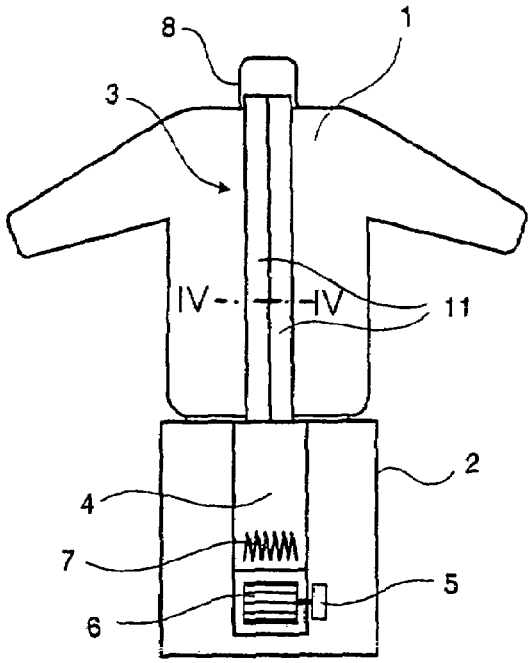
FIG. 1 is a schematic front view of an apparatus according to the invention for pressing shirt-like items of clothing with an inflatable body and a button-strip clamp.

Referring now to the schematic figures of the drawing in detail and first, particularly, to FIG. 1 thereof, there is shown an apparatus for pressing shirt-like items of clothing. The apparatus has a bottom part 2 with an inflatable body 1 fastened thereon. The inflatable body 1 is shirt-like and has a trunk section and two sleeve sections. The inflatable body 1 consists of a non-rigid and air-permeable material. It is also possible for the inflatable body 1 to consist of an air-impermeable material or, in part, of an air-impermeable material and, in part, of an air-permeable material.

The bottom part 2 has, in its interior, a fan 6 which is driven by a motor 5 and of which the output is connected to the inflatable body 1, within the bottom part 2 by means of an air channel 4. With the aid of the fan 6, air can be blown into the inflatable body 1 in order to generate a positive pressure therein and/or to inflate it. Since the inflatable body 1 consists of an air-permeable material, air can escape out of it. During operation of the fan 6, an equilibrium is thus established at a pressure at which the air fed into the inflatable body 1 by the fan 6 escapes again through the enclosure of the inflatable body 1. The air channel 4 contains an electric heater 7 by means of which the air fed into the inflatable body 1 by the fan 6 can be heated.

A button-strip clamp 3 is disposed on the bottom part 2. The clamp 3 extends at a small distance in front of the inflatable body 1, longitudinally in relation to the latter. The button-strip clamp 3 is used, in the operation of pressing shirts which are generally open at the front, for fixing the button strip and the buttonhole strip of a shirt which is to be pressed, in order that the shirt remains closed at the front when the inflatable body 1 is inflated. It is generally possible to use the button-strip clamp 3 to fix the edges of a front-opening shirt-like item of clothing such as, for example, a jacket for pressing purposes. Also arranged on the bottom part 2 is a framework 8 which runs within the inflatable body 1. The top end of the framework 8 projects beyond the inflatable body 1 and bears an arrangement for clamping and pressing collars of a shirt which is to be pressed.

The button-strip clamp 3 is constructed from a base plate 12 and two tensioning flaps 11 which are articulated at the front in the center of the base plate 12. The tensioning flaps 11 can be prestressed in relation to the base plate 12 by spring force in order for the edges of a front-opening item of clothing and, in particular, the button strip and/or the buttonhole strip of a shirt to be forced against the base plate 12 for fixing purposes. The surface of the base plate 12 thus forms a tensioning surface against which it is possible to clamp the parts of the item of clothing which are to be fixed. The facing surfaces of the base plate 12 and of the tensioning flaps 11 may have a coating made of a material which enhances the adherence in relation to the clamped material, in order for it to be possible for the item of clothing to be better fixed.

Figure 2:
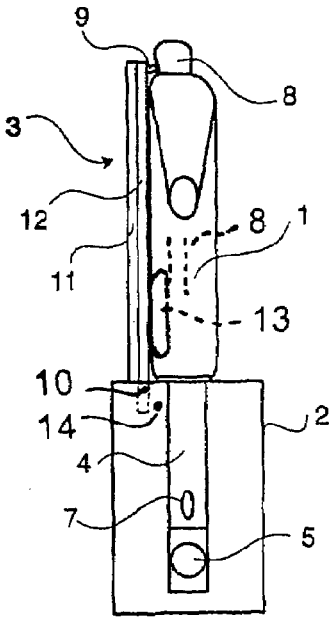
FIG. 2 is a side view of the apparatus according to FIG. 1, with the button-strip clamp disposed directly in front of the inflatable body.

Furthermore, the pressing apparatus, which is illustrated in side view in FIG. 2, has, at the top, a connecting means 9 by way of which the top end of the button-strip clamp 3 can be connected to the framework 8. The connecting means 9 is connected to the button-strip clamp 3 and configured such that it can interact with a counterpart on the framework 8 and can be released easily and quickly by an operator. At its bottom end, the button-strip clamp 3 is connected to the bottom part 2 via a pivot joint 10. The pivot joint 10, at which the button strip 3 is articulate, is configured such that, with the connecting means 9 open, the button-strip clamp can be swung away from the inflatable body 1. The pivot joint is associated with a stop 14 which limits the swinging movement of the button-strip clamp 3. FIG. 2 illustrates the button-strip clamp 3 in its operating position, in which it is disposed in close vicinity of the inflatable body 1, and it is locked in this position by the closed connecting means 9.

Figure 3:
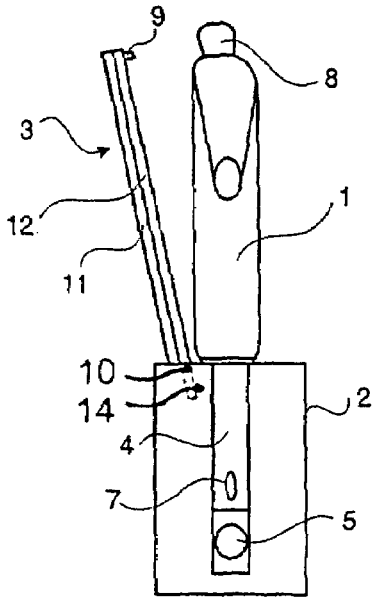
FIG. 3 is a similar view of the apparatus according to FIG. 1 with the button-strip clamp spaced apart from the inflatable body.

Following release of the connecting means 9, the button-strip clamp 3 can be swung, until the articulation comes to a stop, into a parked position, in which the button-strip clamp 3 in FIG. 3 is illustrated. In this position, there is sufficient space between the inflatable body 1 and the button-strip clamp 3 in order for even items of clothing which cannot be opened or which are closed to be pulled onto the inflatable body 1. The button-strip clamp 3 is retained in this parked position by gravitational force, with the result that it cannot swing back accidentally.

In a development, the pressing apparatus may also have a spring which prestresses the button-strip clamp 3 in a swinging direction. For example, it is possible for the spring to force the button-strip clamp 3 away from the inflatable body 1, with the result that, following release of the connecting means 9, it moves into its parked position of its own accord. It is also conceivable, however, for the spring to force the button-strip clamp 3 in the direction of the inflatable body 1, in which case the button-strip clamp 3 has to be capable of being locked in its parked position. Following release of this locking, the button-strip clamp 3 returns into its operating position of its own accord.

For the purpose of pressing an item of clothing, the latter is pulled onto the inflatable body 1, preferably in the damp state, and fixed with the aid of the button-strip clamp 3 such that it cannot open up at the front. For this purpose, the button strip and/or the buttonhole strip is clamped between the tensioning flaps 11 and the base plate 12. Air heated with the aid of the fan 6 and the heater 7 is then blown into the inflatable body 1, which thus inflates.

By virtue of being inflated, the inflatable body 1 positions itself against the inside of the item of clothing which is to be pressed, forces the material of the item of clothing outward and thus tensions the same. This tensioning operation causes the material of the item of clothing to be pressed. At the same time, the item of clothing is heated and dried by the heated air which flows out of the inflatable body 1 from the inside. The pressing action of the tensioning operation is yet further enhanced by the heat. The item of clothing is preferably pulled onto the inflatable body 1 in the damp state, tensioned and dried under tensioning to the desired residual moisture content.

In a preferred embodiment of the invention, the apparatus includes devices for supporting the inflatable body 1 from inside. They are set up such that they can force the inflatable body 1 against the button-strip clamp 3 when the button-strip clamp 3 is in its operating position. By way of example, the supporting devices are inflatable cushions 13 that are arranged within the inflatable body 1. The cushions 13 can be inflated to a higher inflating pressure than the inflatable body 1 in general, and they are supported against a framework 8 in the interior of the inflatable body 1. The framework 8 is fixed to the apparatus, i.e., it is fixedly disposed on the lower part 2 of the apparatus.

Figure 4:
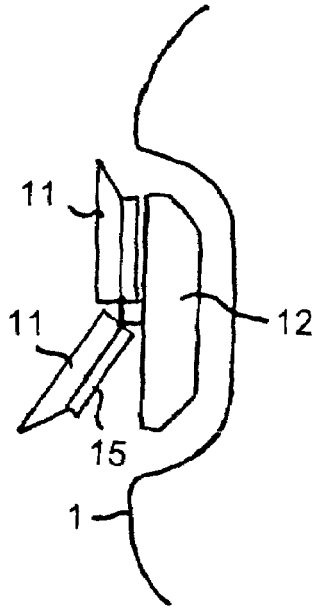
FIG. 4 is a horizontal section taken through the button-strip clamp and a portion of the inflatable body according to the invention along the line IV—IV in FIG. 1.

The partial section of FIG. 4 illustrates the button-strip clamp 3 in more detail and in its general operating position. One of the flaps 11 is open and the other one is closed. The base plate 12 is disposed such that it is approximately aligned, i.e., in a common plane, with the adjoining portions of the inflatable body. This ensures that the article of clothing to be pressed is properly aligned when the inflatable body is inflated. The tensioning flaps 11 is provided with a coating layer, such as a soft rubberized strip 15. The edges of the item of clothing can thereby be held tightly and without slipping, and further without damaging the buttons or other closure devices.

Additional information and details with regard to the pressing apparatus may be found in my copending applications that are based on PCT/EP02/12336, PCT/EP02/12586, and PCT/EP02/12587; the copending applications are herewith incorporated by reference in their entirety.

I claim:

1. An apparatus for pressing items of clothing, comprising:

an inflatable body having a shirt-like form;

a button-strip clamp for fixing free edges of an openable item of clothing disposed in a vicinity of said inflatable body and movable into an operating position in close yicinity in front of said inflatable body; and an inflatable supporting device for supporting the inflatable body.

2. The apparatus according to claim 1, wherein said button-strip clamp, in the operating position thereof, is disposed substantially without a spacing distance from said inflatable body.

3. The apparatus according to claim 1, wherein said button-strip clamp, in the operating position thereof, is disposed at a small spacing distance from said inflatable body.

4. The apparatus according to claim 1, further comprising a locking device for releasably fastening said button-strip clamp in the operating position thereof.

5. The apparatus according to claim 4, wherein said locking device includes a pivot joint about which said button-strip clamp is articulated for pivoting away from said inflatable body out of the operating position of said button strip clamp.

6. The apparatus according to claim 5, which comprises a stop device associated with said pivot joint for limiting an amount of tilting of said button-strip clamp.

7. The apparatus according to claim 5, wherein said pivot joint is disposed at a bottom end of said inflatable body.

8. An apparatus for pressing items of clothing, comprising:

an inflatable body having a shirt-like form;

a button-strip clamp for fixing free edges of an openable item of clothing disposed in a vicinity of said inflatable body and movable into an operating position in close vicinity in front of said inflatable body;

a locking device for releasably fastening said button-strip clamp in the operating position thereof;

wherein said locking device has a connector for releasably connecting said button-strip clamp to a framework supporting said inflatable body; and an inflatable supporting device for supporting the inflatable body.

9. The apparatus according to claim 8, further comprising a locking device for releasably fastening said button-strip clamp in the operating position thereof, wherein said locking device has a connector for releasably connecting said button-strip clamp to a framework supporting said inflatable body.

10. An apparatus for pressing items of clothing, comprising:

an inflatable body having a shirt-like form;

a button-strip clamp for fixing free edges of an openable item of clothing disposed in a vicinity of said inflatable body and movable into an operating position in close vicinity in front of said inflatable body; and a locking device for releasably fastening said button-strip clamp in the operating position thereof, wherein said locking device includes a pivot joint about which said button-strip clamp is articulated for pivoting away from said inflatable body out of the operating position of said button strip clamp and a top connector for releasably connecting said button-strip clamp at a top end thereof to a framework fixedly disposed on a support for said inflatable body.

11. The apparatus according to claim 10, wherein said framework is disposed at least partially within said inflatable body.

12. The apparatus according to claim 1, which comprises devices for supporting the inflatable body disposed to force said inflatable body against said button-strip clamp when said button-strip clamp is in the operating position.

13. An apparatus for pressing items of clothing, comprising:

an inflatable body having a shirt-like form;

a button-strip clamp for fixing free edges of an openable item of clothing disposed in a vicinity of said inflatable body and movable into an operating position in close vicinity in front of said inflatable body;

a locking device for releasably fastening said button-strip clamp in the operating position thereof;

supporting devices for supporting the inflatable body disposed to force said inflatable body against said button-strip clamp when said button-strip clamp is in the operating position; and wherein said supporting devices are inflatable cushions disposed within said inflatable body, said cushions being configured to be inflated at a higher inflating pressure than said inflatable body and supported against a framework in an interior of said inflatable body.

14. The apparatus according to claim 13, which comprises a support carrying said button-strip clamp, said inflatable body, and said framework.

15. The apparatus according to claim 13, wherein said button-strip clamp is formed with tensioning surfaces for clamping edges of an item of clothing, and wherein, in the operating position of said button-strip clamp, said tensioning surfaces are substantially disposed in a mutual plane with adjoining segments of said inflatable body adjoining said button-strip clamp in the operating position thereof.

* * * * *